US006568964B2

(12) United States Patent
D'Addario

(10) Patent No.: US 6,568,964 B2
(45) Date of Patent: May 27, 2003

(54) RCA-TYPE ELECTRICAL PLUG CONNECTOR

(75) Inventor: James D'Addario, Old Westbury, NY (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 09/944,530

(22) Filed: Aug. 31, 2001

(65) Prior Publication Data

US 2002/0025729 A1 Feb. 28, 2002

Related U.S. Application Data

(63) Continuation-in-part of application No. 09/478,872, filed on Jan. 7, 2000.

(51) Int. Cl.[7] ..... H01R 17/04
(52) U.S. Cl. ..... 439/675
(58) Field of Search ..... 439/675, 668, 439/578, 583, 814, 827, 394, 460, 427, 825

(56) References Cited

U.S. PATENT DOCUMENTS

| | | | | | |
|---|---|---|---|---|---|
| 3,893,743 | A | | 7/1975 | Wallo | |
| 4,493,525 | A | * | 1/1985 | Hall et al. | 439/585 |
| 4,526,429 | A | | 7/1985 | Kirkman | |
| 5,147,221 | A | * | 9/1992 | Cull et al. | 439/585 |
| 5,376,022 | A | * | 12/1994 | Carr et al. | 439/668 |
| 5,915,995 | A | | 6/1999 | Meyer et al. | |
| 5,951,337 | A | * | 9/1999 | Brake | 439/825 |
| 6,093,054 | A | * | 7/2000 | Merkle et al. | 439/493 |
| 6,309,258 | B1 | * | 10/2001 | Measley | 439/224 |

FOREIGN PATENT DOCUMENTS

| | | | |
|---|---|---|---|
| DE | 42 40 556 A1 | | 6/1993 |
| EP | 0 923 170 A2 | | 6/1999 |
| JP | 4-8278 | * | 2/2000 |

* cited by examiner

*Primary Examiner*—Lynn D. Feild
*Assistant Examiner*—Phuong K Dinh
(74) *Attorney, Agent, or Firm*—Alix, Yale & Ristas, LLP

(57) ABSTRACT

An RCA plug connector includes an annular outer ground sleeve, an insulating ring within the sleeve, and an elongated signal probe member having an exterior spring, extending from within the insulating ring along the central axis. The spring includes at least one axially extending portion bowed radially outward of the central axis of the probe member. The bowed portion may include a plurality of circumferentially spaced axially extending bowed portions. The conductive sleeve may have at least one finger portion extending radially inwardly, with an arcuate or a generally V-shaped tip cross section.

21 Claims, 12 Drawing Sheets

RCA-TYPE ELECTRICAL PLUG CONNECTOR

CROSS REFERENCE TO RELATED APPLICATION

The present application is a continuation-in-part of copending U.S. patent application Ser. No. 09/478,872, entitled "Electrical Plug and Jack Connectors", filed on Jan. 7, 2000 and assigned to J. D'Addario & Company, Inc.

BACKGROUND OF THE INVENTION

The present invention relates generally to RCA type electrical plug and jack connectors and, more particularly, to electrical plug and jack connectors configured to provide reduced relative movement when connected together and thereby reduce the likelihood of intermittent electrical discontinuity.

Plug connectors are well known for use in connecting, e.g., audio equipment. With RCA-type plugs, a ground sleeve or the like surrounds a central signal pin. One such plug is used for mono (single channel) transmission and two side-by-side plugs are used for stereo (two-channel) transmission. Generally, the mating contacts for the pins and sleeves with associated jack structures are smooth. Because of, e.g., resiliency and tolerances between the structures, the plugs are somewhat moveable within the jack and through wear and the like the movement increases. This often leads to intermittent contact and a resulting disturbance in the quality of the audio signal.

SUMMARY OF THE INVENTION

Accordingly, it is an object of the present invention to provide an RCA-type plug connector that achieves reduced relative movement when mated with a jack connector.

In accordance with an embodiment of the present invention, an RCA plug connector has a radially outwardly extending spring carried by the pin, or elongated probe, which extends axially from the plug base or body. A conductive ground sleeve also projects from the base, is disposed about the probe member in substantially coaxial relation, and insulated therefrom. As is typical, the RCA plug connector further includes an insulating ring. The insulating ring has a central aperture and is interposed between the probe member and the conductive sleeve. The conductive sleeve may also include a radially inward extending spring means, such as at least one spring finger having an arcuate or generally V-shaped cross section that extends radially inwardly.

Preferably, the spring on the probe comprises at least one outward, bowed portion. The bowed portion may extend radially outward of the central axis of the probe member and may comprise a plurality of circumferentially spaced, bowed metal strips. The plug connector probe may thus have a central core with a nose or head portion at the free end, with the spring strips carried by the core intermediate the nose and the plug base.

The probe member and the conductive sleeve may each comprise a material selected from the group consisting of brass, copper, phosphor, beryllium copper bronze, and steel plated with gold, nickel or silver.

BRIEF DESCRIPTION OF DRAWINGS

Other objects and advantages of the invention will be evident to one of ordinary skill in the art from the following detailed description made with reference to the accompanying drawings, in which.

DESCRIPTION OF THE PREFERRED EMBODIMENTS

Figure 1:
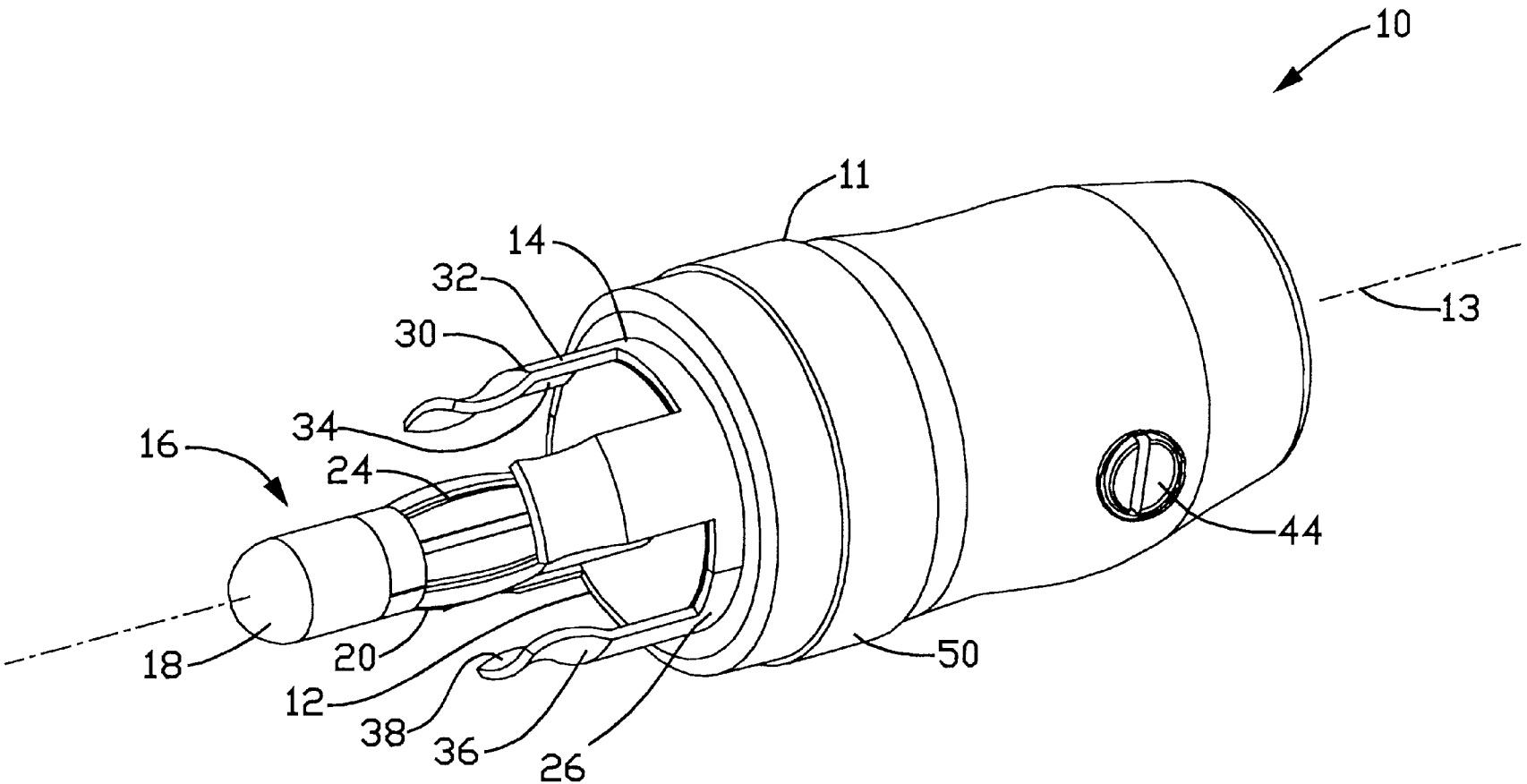
FIG. 1 is a perspective view of an RCA plug connector in accordance with a first preferred embodiment of the present invention.
Figure 2A:
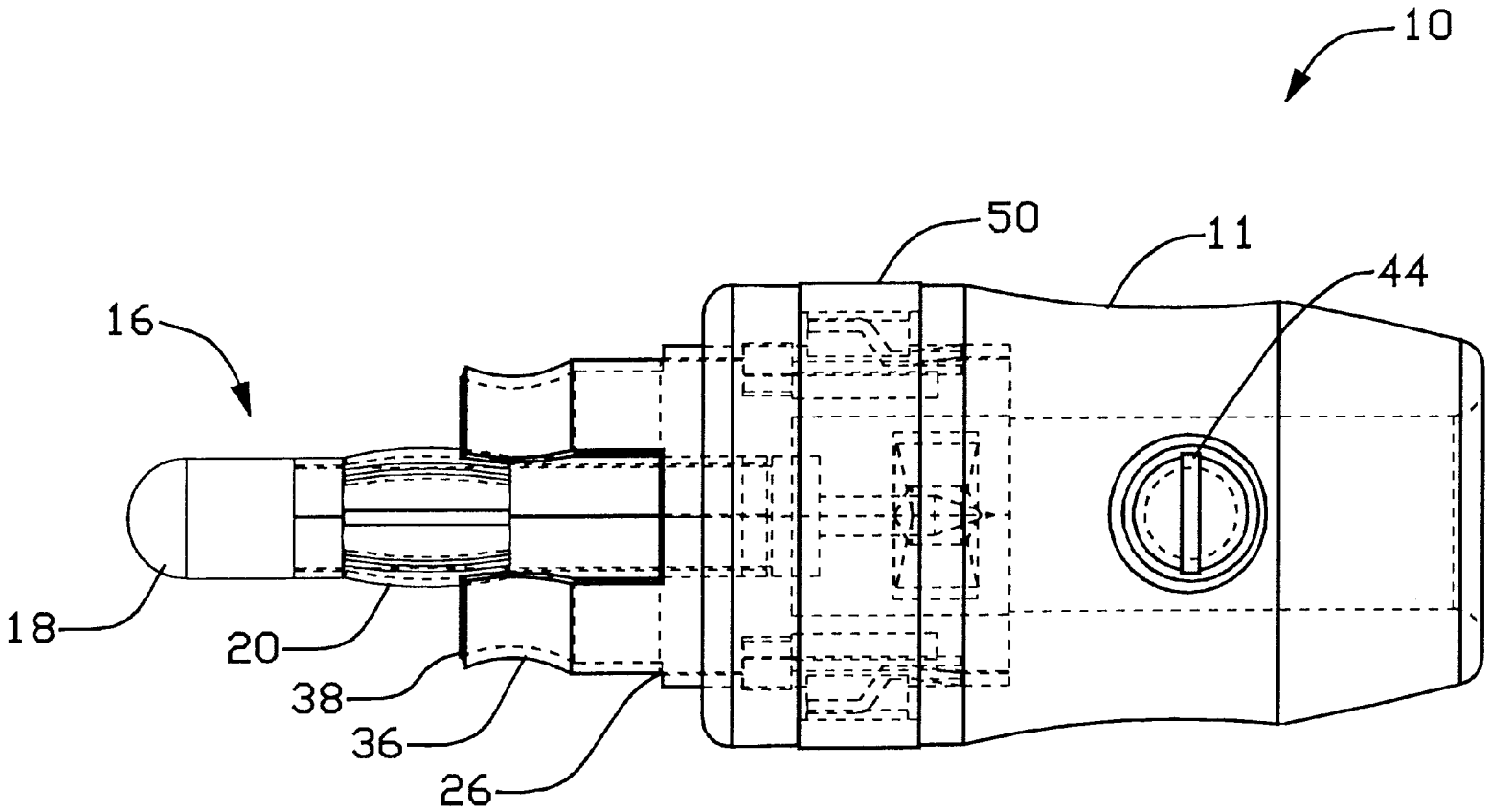
FIG. 2A is a plan view of the RCA plug connector, illustrated in FIG. 1.
Figure 2B:
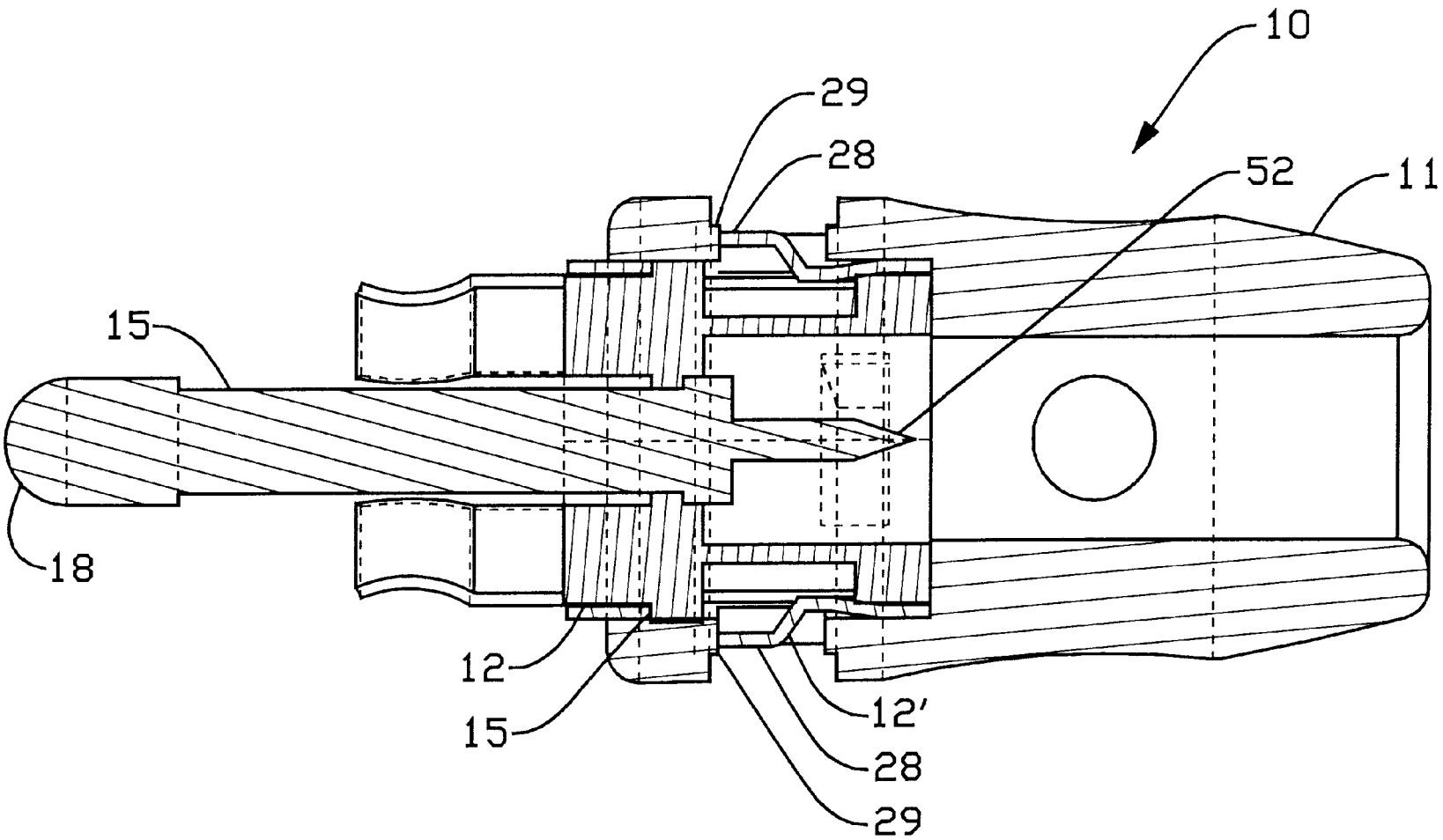
FIG. 2B is a cross-sectional view similar to FIG. 2A, simplified by the omission of the exterior spring portion for clarity.
Figure 3:
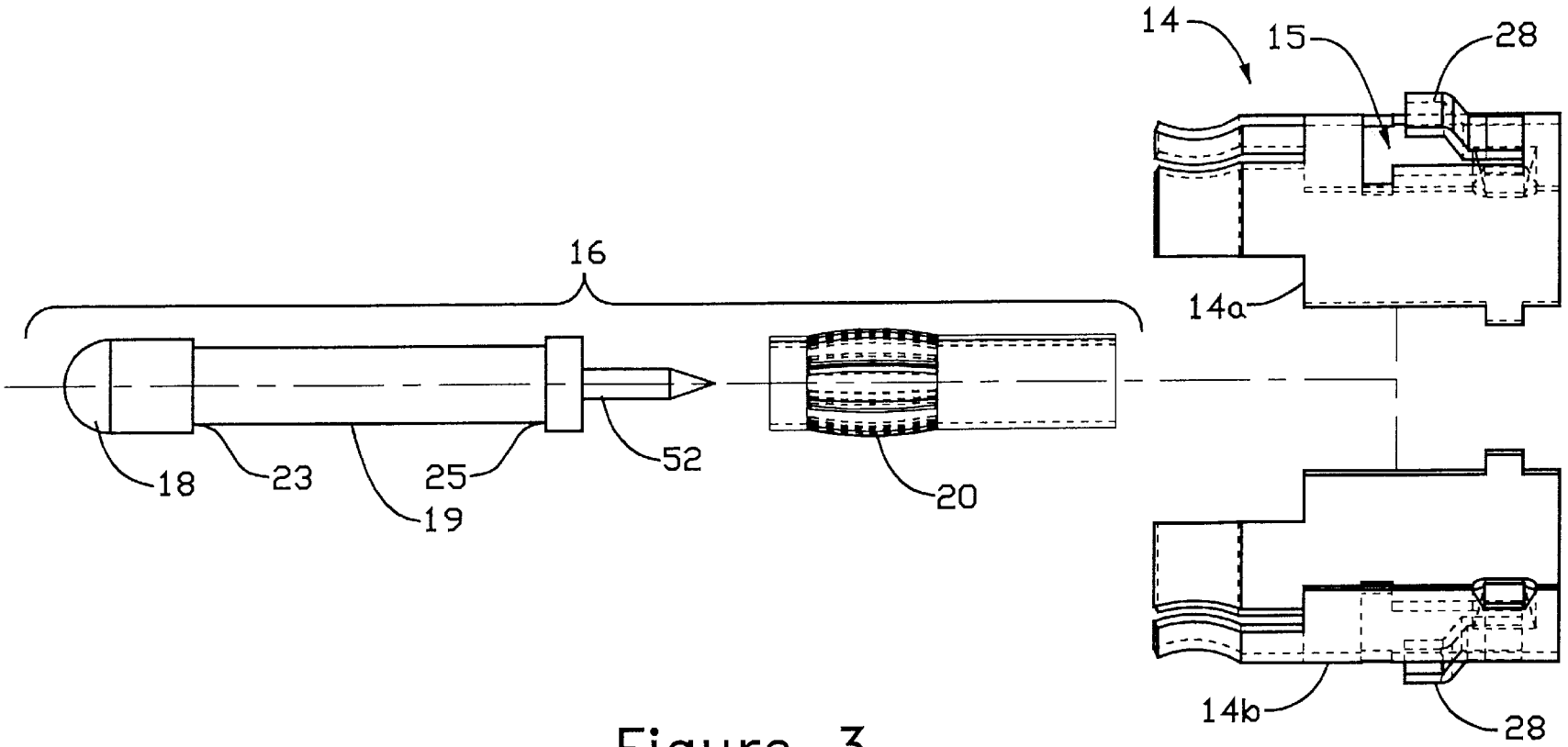
FIG. 3 is an exploded side elevation view of the left part of the RCA plug connector, illustrated in FIG. 2.
Figure 4:
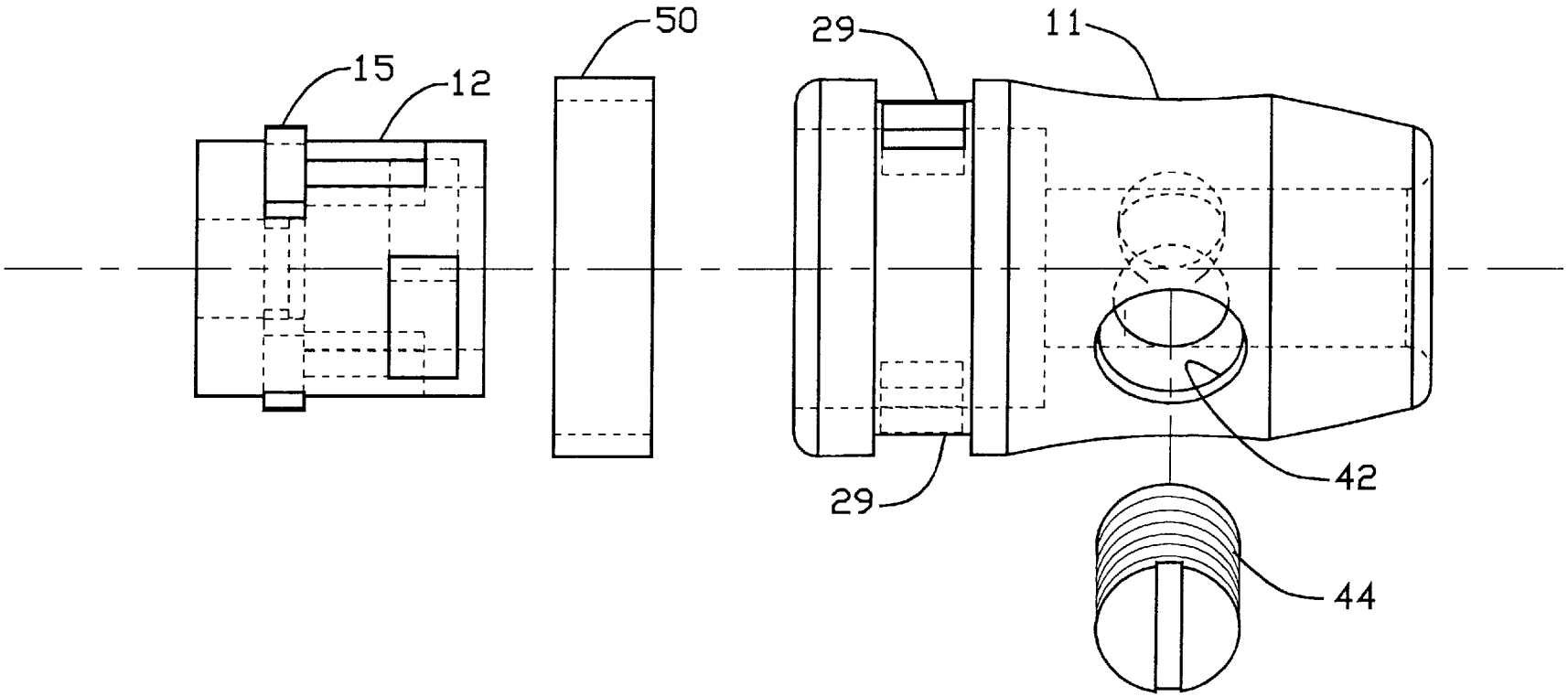
FIG. 4 is an exploded side elevation view of the right part of the RCA plug connector, illustrated FIG. 2.
Figure 5:
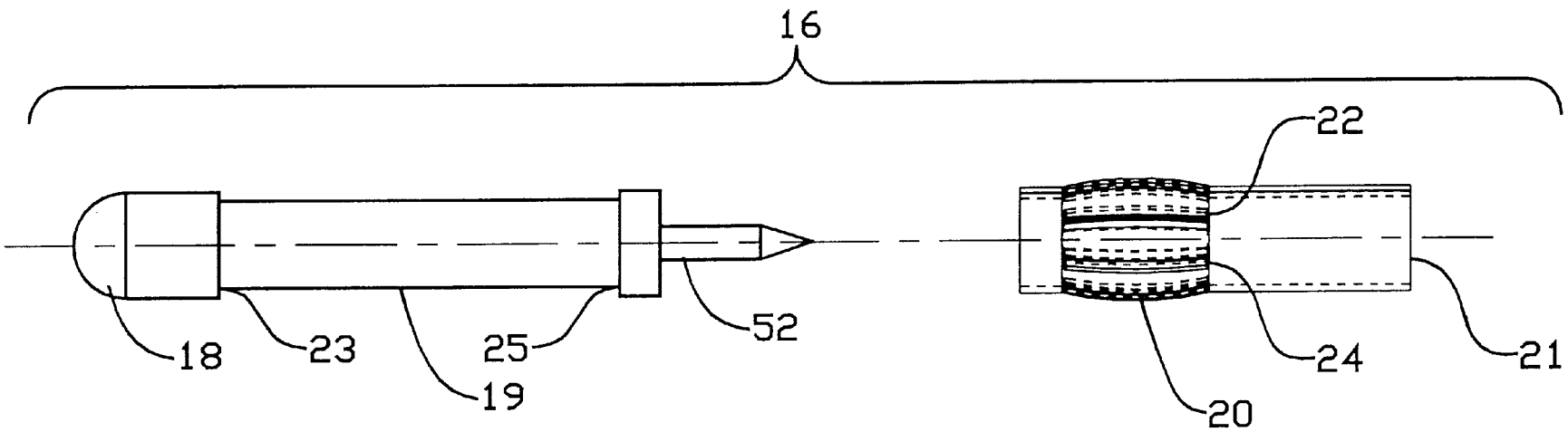
FIG. 5 is an exploded side elevation view to an enlarged scale of the signal tip and banana spring section of the apparatus, illustrated in FIG. 3.
Figure 6:
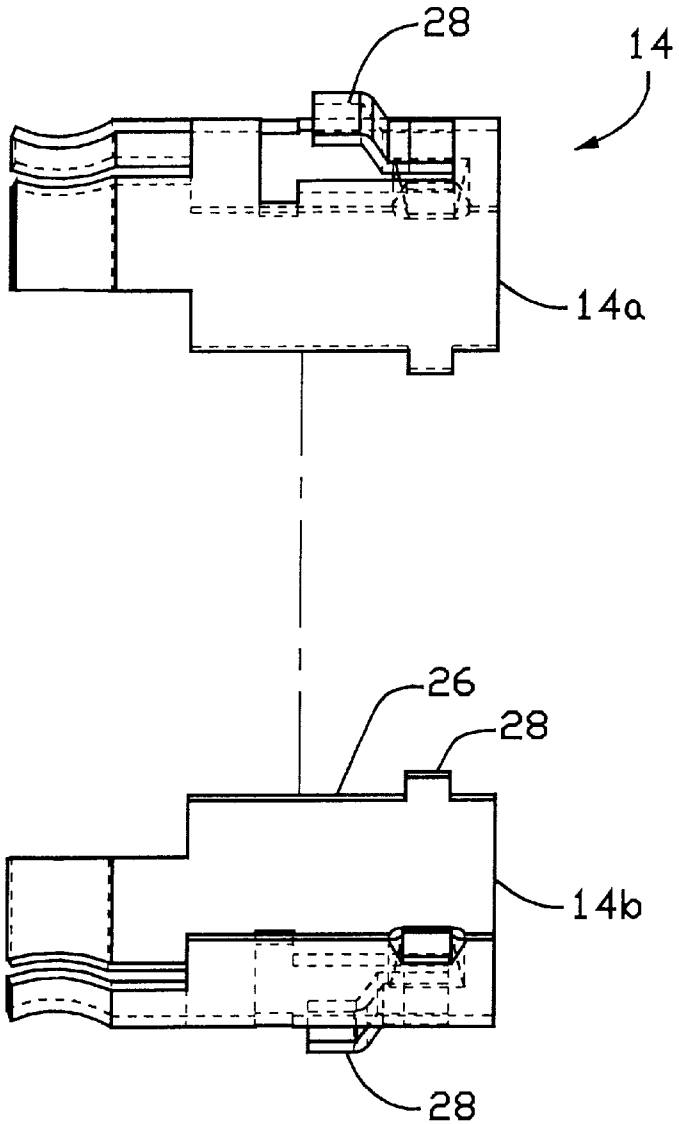
FIG. 6 is an exploded side elevation view to an enlarged scale of the outer half shells, illustrated in FIG. 3.
Figure 7:
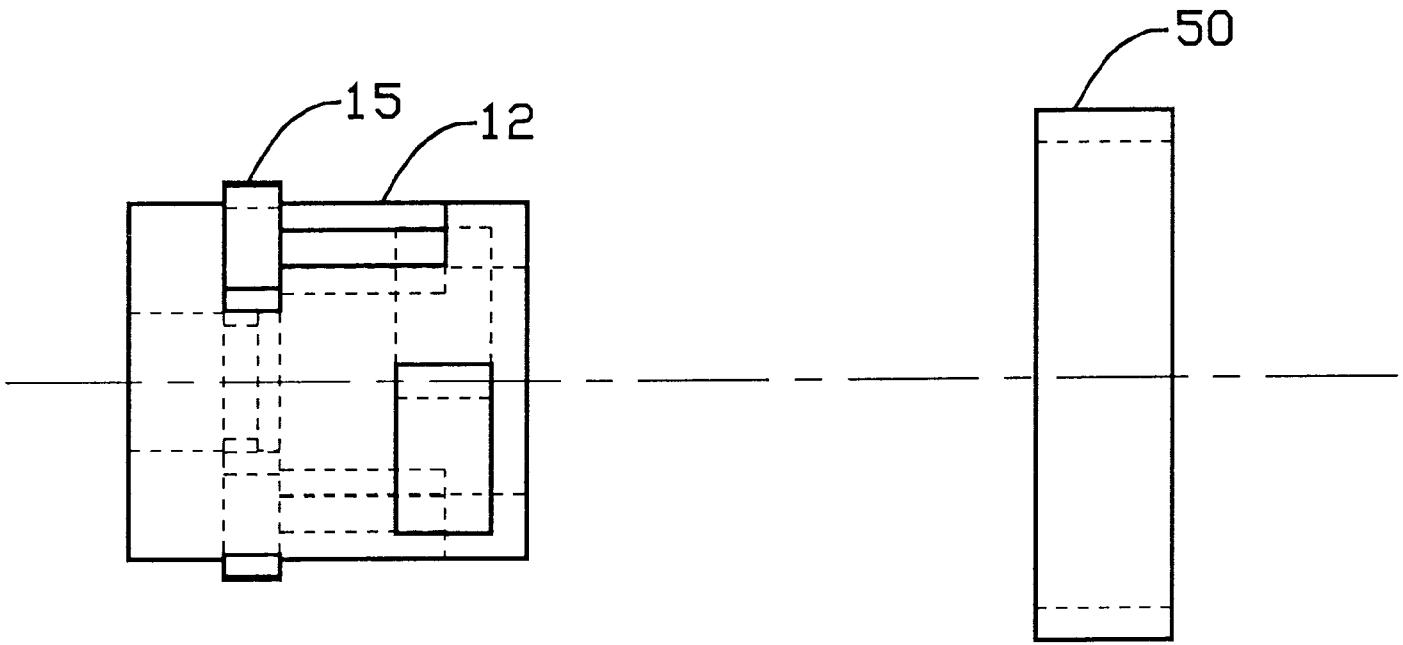
FIG. 7 is an exploded side elevation view to an enlarged scale of the inner insulator and color-coded ring, illustrated in FIG. 4.
Figure 8:
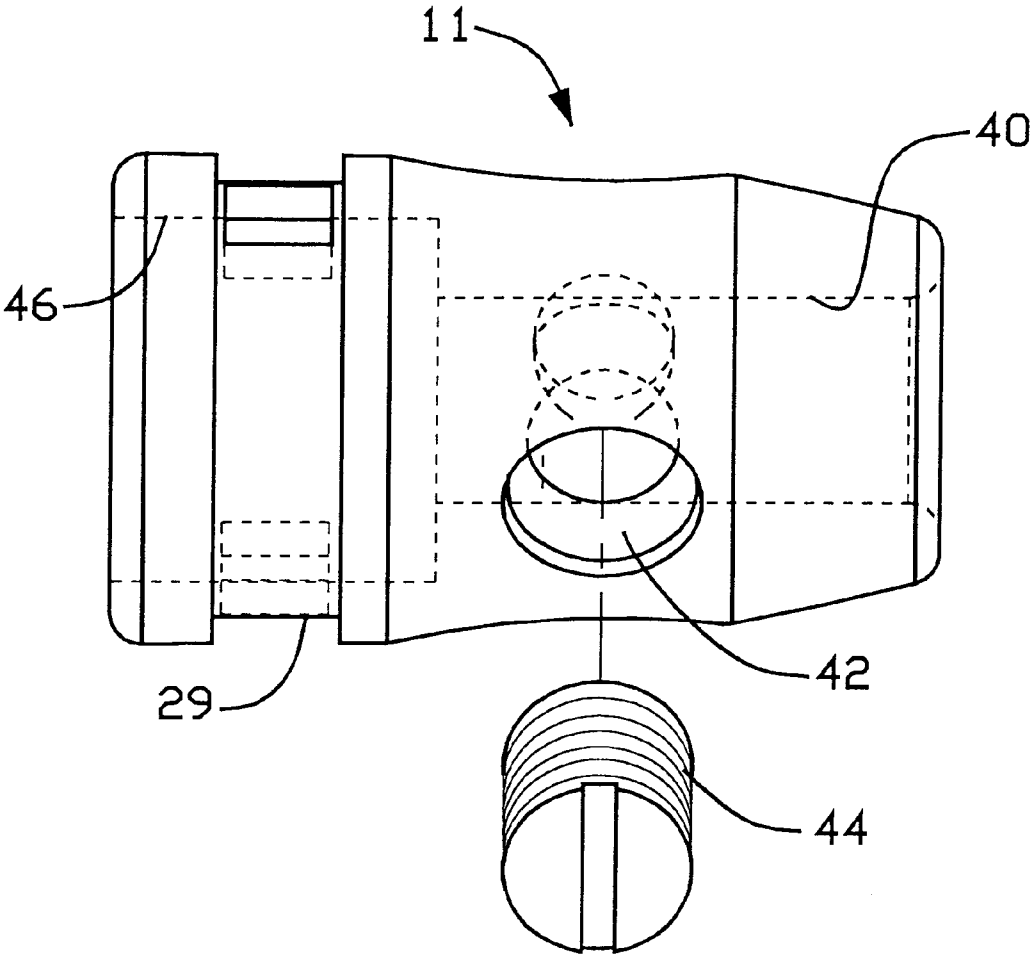
FIG. 8 is a side elevation view to an enlarged scale of the die cast shell, illustrated in FIG. 4.

A plug connector 10 in accordance with one embodiment of the present invention is illustrated in FIGS. 1–8. The plug connector 10 has a base 11 and an insulating ring 12 interposed between a conductive ground sleeve 14 and a conductive signal probe member 16. The sleeve 14 is preferably formed from two mating half shells 14*a* and 14*b* that extend from the base and are disposed annularly about the probe member in substantially coaxial relation. The insulating ring 12 is preferably comprised of a molded plastic material such as a molded thermoplastic, e.g., acetyl resin, nylon, ABS resin and/or blends thereof. The sleeve 14 is composed of a conductive material, may be formed from sheet stock and is disposed coaxially about the insulating ring 12. The sleeve 14 is electrically connected to e.g. the ground shield of an electrical wire or cable (not shown).

The pin or probe member 16 extends from the base 11, along a central axis 13 and comprises a conductive body or core 19, having a rounded head 18 at the free end and an exterior spring portion 20. The spring portion 20 comprises axially extending slots or spaces 22, disposed between axially extending bulged portions 24. The spring portion 20 is a generally cylindrical sleeve shaped member having an axially extending slit 21 to permit expansion for assembly onto the axial portion of the body 19 that is intermediate the shoulders 23, 25 thereof. In this manner, the probe member 16 is formed in two pieces and is preferably composed entirely of metallic components whereby a signal may be conducted thereby.

Figures 9, 10:
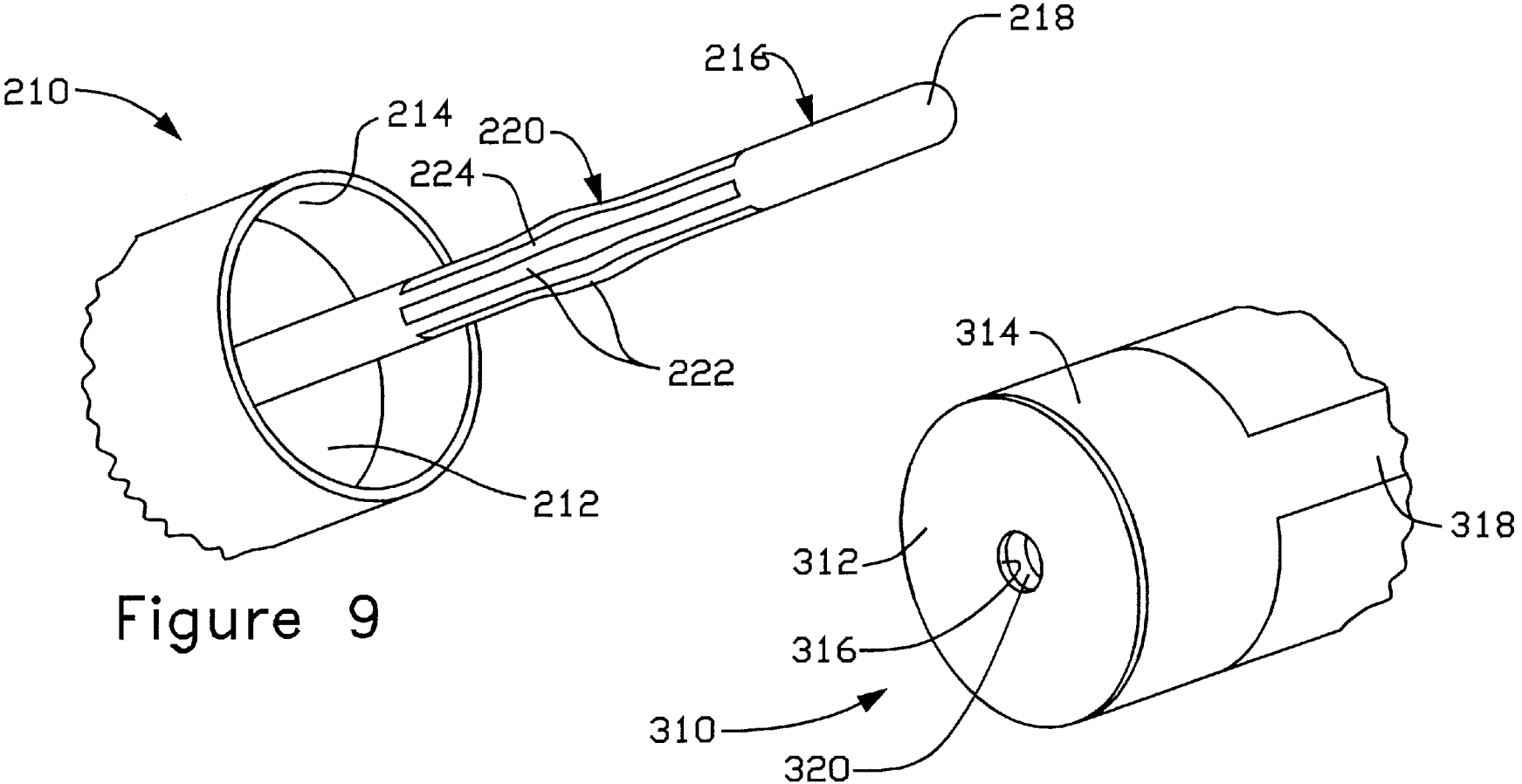
FIG. 9 is a partial schematic view of an RCA plug connector in accordance with a second embodiment of the present invention.
FIG. 10 is a perspective view of a rudimentary jack for receiving an RCA plug according to an embodiment of the invention described herein.

The plug connector 10 is dimensioned and configured for cooperation with a conventional RCA type jack connector 310 (FIG. 10). The jack connector 310 comprises an insulating cylinder 312, a conductive ground band or collar 314 and a central cavity or bore 316.

The insulating cylinder 312 may be formed of any suitably strong and durable material such as a plastic, for example, a polyolefin and is dimensioned to fit within the sleeve 14, of the plug connector 10. The conductive band or collar 314 circumscribes the end of the insulating cylinder 312, and electrically contacts the ground sleeve 14 when the plug connector 10 is mated with the jack connector 310. A conductive line 318 connects the collar 314 with, e.g., a ground wire (not shown). The central cavity 316 has a conductive signal wall 320, which may be coated or provided with a conductive, sleeve and is dimensioned to receive the probe member 16.

When mated, the plug probe 16 is fully inserted into and engages the inner surface 320 of the central signal bore 316 in the jack and the plug sleeve 14 engages the outer surface of the collar 314 on the jack. The spring portion 20 of the probe member 16 will be compressed against the signal bore wall 320 to provide increased friction and prevent undesirable disruption of electrical continuity. The outer diameter of the spring 20, with no external forces applied to it, is equal to or greater than the nominal internal diameter of the jack signal bore wall 320.

In this embodiment (FIGS. 1–8), the assembled sleeve 14 consists of a split ring portion 26, with tabs 28 engaging recesses 29 in the base 11. The split ring portion 26 has a plurality; e.g., four circumferentially spaced apart fingers 30. Each finger 30 has an arcuate stem portion or first axial portion 32 having an internal axis of curvature 34 substantially coincident with the axis 13 and sized to match the outside diameter of the collar 314 on the jack 310. Each finger 30 has a tip portion or second axial portion 36 that has a radially inward curvature 38 having a center of curvature disposed outside the sleeve 14 outside diameter. When the plug connector 10 is not installed in a jack connector 310 and thus, there is no external force applied to the fingers 30, the tips 36 of the fingers 30, with this radially inward curvature 38, define a circle that has a smaller diameter than the outside diameter of the collar 314. Thus, the spring-tempered fingers 30 provide an inward force against the collar 314 when the plug connector 10 is installed on the collar 314 of the jack connector 310.

The coaxial cable is preferably coupled to the plug 10 by a solder less connection. More particularly, a die cast cylindrical or barrel shaped body or base 11 is provided with a bore 40 dimensioned and configured for receiving the coaxial cable. A laterally extending threaded cross bore 42, having an optional counter bore (not shown) cooperates with a setscrew 44. In other embodiments of the invention, the setscrew 44 will have a head that cooperates with the counter bore. In the embodiment of the invention having a set screw with a head, the depth of the counter bore and the length of the set screw are dimensioned and configured to allow engagement of the shielding of the coaxial cable, while limiting the maximum travel of the set screw and thus preventing excessive travel of the set screw that would damage the coaxial cable. This dimensioning insures that a good contact is made with the coaxial cable and particularly the shielding, with no significant risk of damaging the coaxial cable.

Before the set screw is advanced, the front of the coaxial cable is pushed fully into the bore 40 so that the point 52 of the core 19 of probe 16 penetrates the cable and makes contact with the central, signal wire of the coaxial cable. The insulating ring 12 is secured within the sleeve 14 by protrusions 15 that extend through the conductive ground sleeve 14 and retain the conductive ground sleeve 14 in place when the base 11 is secured over the sleeve 14 and ring 12.

The pin core 19 is insert molded within the insulating ring 12. The ring 12 has a substantially cylindrical surface configured for mounting the split ring portion 26. Thereafter, the base 10 is pressed around the split ring portion 26. In other words, the base 10 is axially slid over the split ring portion until the opposed tabs 28 engage the opposed recesses 29 in the base 11. Thereafter, the ring 50 is positioned around the base 11 to cover the tabs 28 and recesses 29.

Referring now to FIG. 9, another embodiment of a plug connector in accordance with the present invention is illustrated generally at 210. This embodiment differs from the embodiment of FIGS. 1–8 in that the outer sleeve 214 is a continuous cylindrical section. The plug connector 210 is formed in accordance with an RCA configuration and includes a spring contact such as that described with respect to the embodiment illustrated in FIGS. 1–8. The plug connector 210 comprises an insulating ring 212 interposed between a sleeve 214 and a probe member 216. The insulating ring 212 is preferably comprised of a molded plastic material such as any of those discussed above. The sleeve 214 is composed of a conductive material, may be formed from a sheet and is disposed about the insulating ring 212. The sleeve 214 may be electrically connected typically to the shield of an electrical cable (not shown).

The probe member 216 comprises a rounded head 218 and a spring portion 220. The spring portion 220 comprises slots or spaces 222 disposed between bulged portions 224 of the probe member 216. In this manner, the probe member 216 is formed in one piece and is preferably composed of a metallic substance to provide conductive properties whereby a signal from a wire (not shown) may be conducted thereby.

When the plug connector 210 is fitted together with a conventional jack connector 310 such as shown in FIG. 10, the probe member 216 fits within the central cavity thereof whereby the spring portion 220 will be compressed against wall 320 to provide increased friction and prevent undesirable disruption of electrical continuity.

Figure 11:
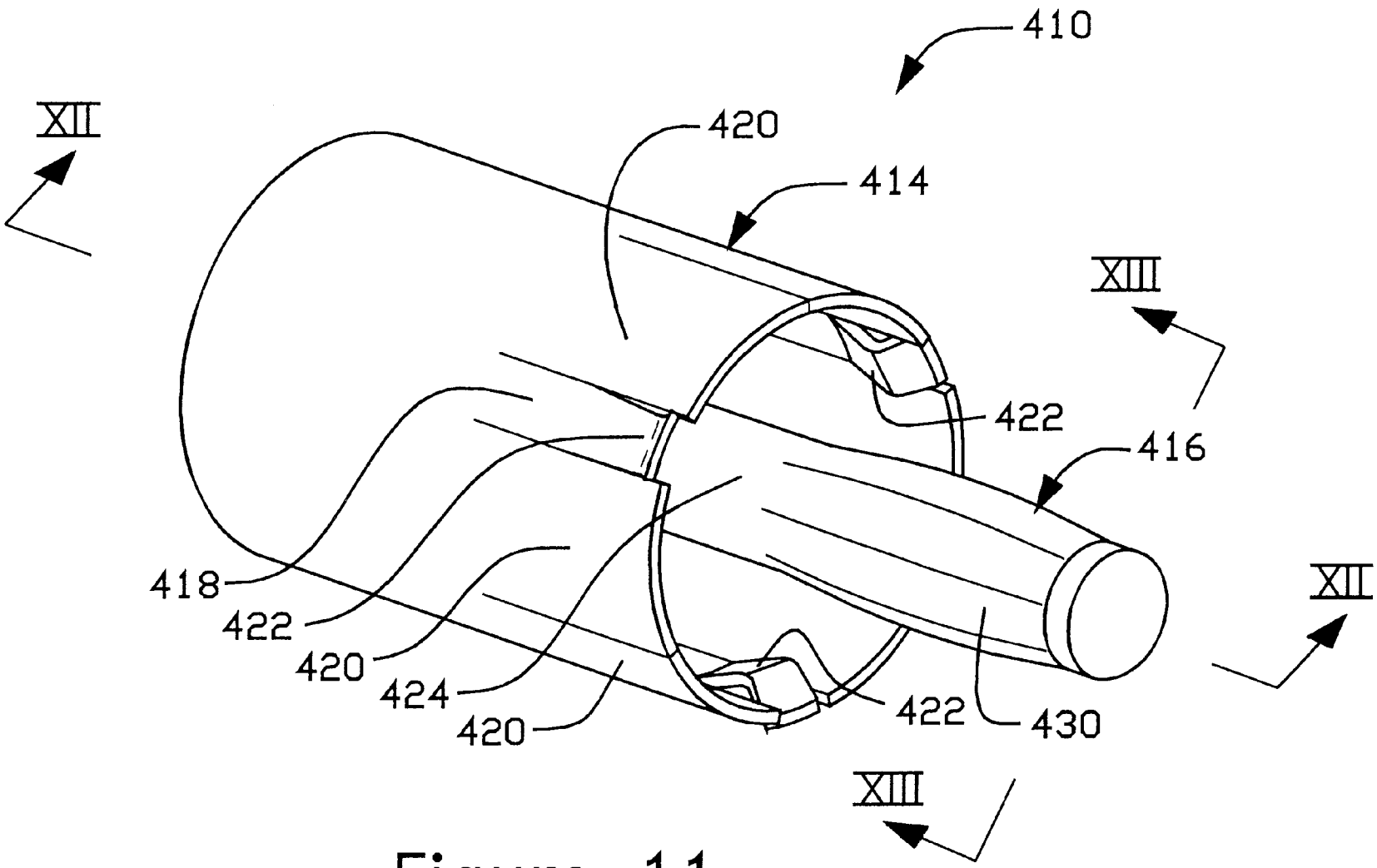
FIG. 11 is a perspective view of an RCA plug connector in accordance with a third embodiment of the present invention.
Figure 13:
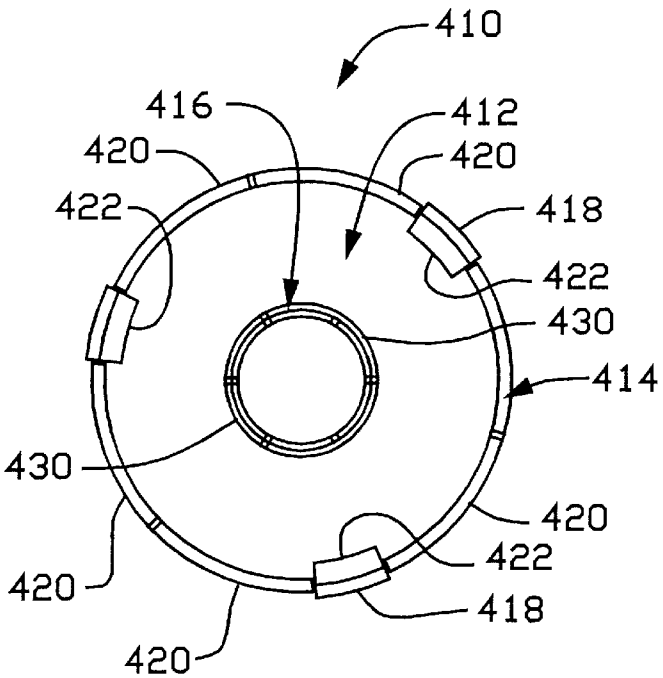
FIGS. 12 and 13 are sectional views taken along lines XII and XIII, respectively of FIG. 11.
Figure 12:
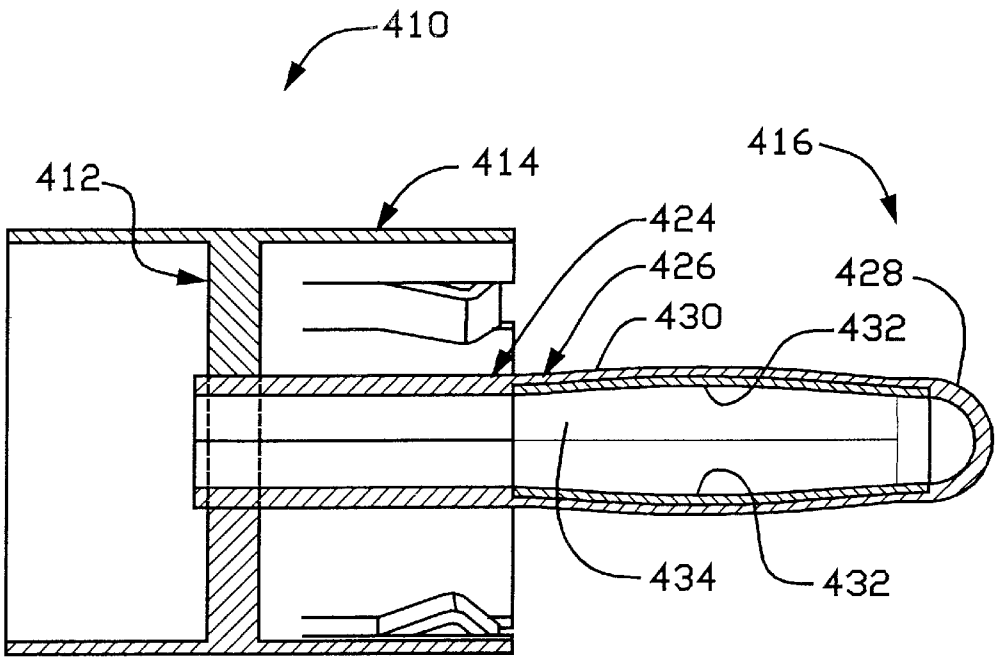

A further embodiment of a plug connector in accordance with the present invention is illustrated generally at 410 in FIGS. 11–13. It will be appreciated that the plug connector 410 has an RCA configuration. The plug connector 410 comprises an insulating ring 412, interposed between a sleeve 414, and a probe member 416.

The insulating ring 412 may be composed of a plastic material such as any thermoplastic material discussed above, and functions to separate the sleeve 414 and probe member 416, which are both conductive.

The sleeve 414 may be composed of, for example, copper, steel, or beryllium copper, plated with, e.g., nickel, copper, silver or even gold for a low resistance, brass, phosphor bronze or other material or alloy. The sleeve comprises contact fingers 418 and 420 that engage a correspondingly shaped jack connector such as the collar 314 (FIG. 10) of the jack connector 310. The contact fingers 418 each include a spring portion 422, having a radially inwardly directed, generally V-shaped cross section. In this embodiment, the fingers have been cut from the cylinder and the remaining portions of the cylinder remain as projections in alternation with the fingers and define web or the like between fingers.

The probe member 416 may be composed of a metallic substance such as any of those described above with respect to the sleeve 414 and comprises a tube portion 424, spring portion 426 and a nose portion 428. The spring portion 426 includes circumferentially spaced strips 430 which may be tempered and may engage both the tube portion 424 and nose portion 428. Members 432 and 434 may be provided within the probe member 416 and may support the strips 430.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. An RCA plug connector comprising:

a base;

an elongated conductive probe member extending from the base along a central axis to a free end and having an exterior spring intermediate the free end and the base, said exterior spring including at least one axially extending radially outwardly bowed spring portion; and a conductive sleeve formed of two mating half shells extending from the base and disposed annularly about the probe member in substantially coaxial relation therewith and insulated therefrom.

2. The RCA plug connector in accordance with claim 1 comprising:

an insulating ring supported by the base between the probe member and the sleeve and defining a central aperture penetrated by said probe.

3. The RCA plug connector in accordance with claim 1, wherein the conductive sleeve includes at least one spring portion that extends inwardly in the absence of external forces.

4. The RCA plug connector in accordance with claim 1, wherein the conductive sleeve includes at least one spring finger portion having a generally V-shaped cross section.

5. The RCA plug connector in accordance with claim 1, wherein the at least one bowed spring portion comprises a plurality of circumferentially spaced bowed portions.

6. The RCA plug connector in accordance with claim 5, wherein the probe comprises a core having a head at the free end and a pair of shoulders intermediate the free end and the base, and the exterior spring is a separate, unitary part supported by the core between said shoulders.

7. The RCA plug connector in accordance with claim 1, wherein the probe member and the conductive sleeve each comprise a material selected from the group consisting of brass, copper, phosphor bronze, steel plated with gold and beryllium copper.

8. The RCA plug connector in accordance with claim 3, wherein said at least one spring portion has a first axial part that is substantially a cylindrical section.

9. The RCA plug connector in accordance with claim 8, wherein said first axial part is adjacent to said base.

10. The RCA plug connector in accordance with claim 7, wherein said at least one spring portion includes a second axial part having an arcuate curve shape extending radially inwardly.

11. The RCA plug connector in accordance with claim 8 further including a plurality of additional spring portions, all of said spring portions being collectively disposed in an array about said elongated conductive probe member, said array being substantially annular and substantially coaxial with said elongated conductive probe member.

12. The RCA plug connector in accordance with claim 11, wherein said plurality of additional spring portions each include a first axial portion that is proximate to the tip thereof that is substantially a cylindrical section.

13. The RCA plug connector in accordance with claim 12, wherein each of said plurality of additional spring portions further includes a second axial section that is adjacent to said first axial portion that is generally arcuate and that extends radially inwardly.

14. The RCA plug connector in accordance with claim 8, wherein said first axial part that is a cylindrical section has an axis of curvature that is coincident with the axis of said probe member.

15. The RCA plug connector in accordance with claim 1, wherein the base includes a first bore dimensioned and configured for receiving an associated coaxial cable, said base further including a second bore disposed in substantially perpendicular relationship to said first bore, said second bore being threaded and said connector further including a threaded member dimensioned and configured for engaging said second bore for engagement with an associated coaxial cable.

16. The RCA plug connector in accordance with claim 5, wherein the base includes a first bore dimensioned and configured for receiving an associated coaxial cable, said base further including a second bore disposed in substantially perpendicular relationship to said first bore, said second bore being threaded and said connector further including a threaded member dimensioned and configured for engaging said second bore for engagement with an associated coaxial cable.

17. The RCA plug connector in accordance with claim 8, wherein the base includes a first bore dimensioned and configured for receiving an associated coaxial cable, said base further including a second bore disposed in substantially perpendicular relationship to said first bore, said second bore being threaded and said connector further including a threaded member dimensioned and configured for engaging said second bore for engagement with an associated coaxial cable.

18. The RCA plug connector in accordance with claim 1, wherein the base includes a first bore dimensioned and configured for receiving an associated coaxial cable, said base further including a second bore disposed in substantially perpendicular relationship to said first bore, said second bore being threaded and said connector further including a threaded member dimensioned and configured for engaging said second bore for engagement with an associated coaxial cable.

19. An RCA plug connector for a coaxial signal cable comprising:

a base having a bore at one end for receiving a coaxial cable;

an elongated conductive signal probe member extending from the other end of the base along a central axis to a free end and having an exterior spring extending longitudinally intermediate the free end and the base; and a conductive sleeve extending from the base and disposed annularly about the probe member in substantially coaxial, spaced, insulated relation therewith, said sleeve formed by two mating half-shells, at least one of which includes a radially extending tab dimensioned and configured for engagement with said base.

20. An RCA plug connector for a coaxial signal cable comprising:

a base having a bore at one end for receiving a coaxial cable;

an elongated conductive signal probe member supported at and extending outwardly from the base along a central axis to a free end and extending within the base to a sharp point on the end opposite the free end for engaging a central signal conductor of a coaxial cable, said probe member further having an exterior spring affixed thereto including a plurality of radially resilient spring elements extending longitudinally to a location on the probe closer to the free end than to the base; and a radially resilient conductive sleeve supported at the base for electrical connection with the outer conductor of said coaxial cable, said sleeve disposed annularly about the probe member in substantially coaxial, spaced, insulated relation therewith, and extending outwardly from the base a lesser distance than the longitudinal extent of the exterior spring of the probe member.

21. The RCA plug of claim 20 wherein the sleeve has tabs engaging said base; and an insulating ring located within said other end of the base has protrusions engaging the sleeve and is molded onto and rigidly supports the probe member.

* * * * *